US005580224A

United States Patent [19]

Ikeda et al.

[11] Patent Number: 5,580,224

[45] Date of Patent: Dec. 3, 1996

[54] RECIPROCATING TYPE COMPRESSOR WITH OIL SEPARATING DEVICE

[75] Inventors: Hayato Ikeda; Hirofumi Sato, both of Kariya, Japan

[73] Assignee: Kabushiki Kaisha Toyoda Jidoshokki Seisakusho, Aichi, Japan

[21] Appl. No.: 457,225

[22] Filed: Jun. 1, 1995

[30] Foreign Application Priority Data

Jun. 3, 1994 [JP] Japan ..... 6-122758

[51] Int. Cl.[6] ..... F04B 1/12

[52] U.S. Cl. ..... 417/269; 417/313; 184/6.17

[58] Field of Search ..... 417/269, 8 B; 184/6.17

[56] References Cited

U.S. PATENT DOCUMENTS 4,019,342 4/1977 Ohta ..... 417/313
4,392,788 7/1983 Nakamura et al. ..... 417/269
5,088,897 2/1992 Kawai et al. ..... 417/269

FOREIGN PATENT DOCUMENTS 04153596 5/1992 Japan .
04175492 6/1992 Japan .
5240158 9/1993 Japan ..... 417/269

*Primary Examiner*—Charles G. Freay
*Attorney, Agent, or Firm*—Burgess, Ryan and Wayne

[57] ABSTRACT

A reciprocating compressor includes reciprocating pistons moved by a swash plate. A housing member is attached to one end of the cylinder block via a valve plate. A discharge chamber is formed in the peripheral region in the housing member, and a suction chamber and an oil chamber are formed in the central region in the housing member in an axially juxtaposed relationship. Alternatively, a suction chamber is formed in the peripheral region, and a discharge chamber and an oil chamber are formed in the central region. The oil chamber is connected to the suction chamber by an oil return passage. A centrifugal type or collision type oil separating device is arranged in the discharge chamber above the oil chamber in the housing member.

13 Claims, 5 Drawing Sheets

RECIPROCATING TYPE COMPRESSOR WITH OIL SEPARATING DEVICE

BACKGROUND OF THE INVENTION

1. Field of the Invention

The present invention relates to an improved reciprocating type compressor having an oil separating device incorporated in the compressor for separating oil from a compressed coolant gas.

2. Description of the Related Art

In reciprocating type compressors and, in particular, in swash plate type compressors or wobble plate type compressors used in an automotive air conditioning devices, oil is contained, in the form of mist, in a coolant gas to lubricate movable elements in the compressor. If the oil mist is discharged from the compressor along with the coolant gas and recirculated in the refrigerating circuit, the oil mist may be deposited onto the inner wall of the evaporator or the like and the heat-exchanging efficiency may be reduced.

Therefore, an oil separator is conventionally arranged in the high pressure piping between the compressor and the condenser so that oil is separated from the coolant gas and returned to the compressor via an oil return pipe. In this case, however, components such as an oil separator and a piping must be manufactured separately from the compressor and be added to the compressor, so the design of the entire refrigerating circuit becomes complex. Further, there is a problem that a narrow and long oil return pipe may be accidentally clogged. Accordingly, a proposal has been made to design a compressor having an oil separating device incorporated in the compressor.

In the known compressor having an oil separating device incorporated therein, one possible arrangement is to incorporate an oil separating device and an oil chamber in a service valve which is attached to the compressor. It is fundamental to design the device such that the separated oil falls by gravity into the oil chamber and is reserved therein, and thus the oil separating means must be arranged above the oil chamber. However, this design results in a bulky service valve and an increased height of the entire compressor.

SUMMARY OF THE INVENTION

The object of the present invention is to provide a reciprocating type compressor having an oil separating device which can be incorporated therein without increasing the height of the entire compressor.

According to the present invention, there is provided a reciprocating type compressor comprising a cylinder block having bores, pistons arranged in the bores and reciprocally moved by moving means, a valve plate attached to one end of the cylinder block, a housing member attached to the cylinder block via the valve plate and having a discharge chamber formed therein, a discharge passage having an opening to the discharge chamber for introducing a compressed coolant gas in the discharge chamber to the outside of the compressor, a suction chamber, oil separating means arranged in the discharge chamber at a position near the opening of the discharge passage, an oil chamber arranged in the housing member for reserving oil separated from the coolant gas by the oil separating means, and an oil return passage connecting the oil chamber to a low pressure part of the compressor.

In this arrangement, the coolant gas is compressed and discharged into the discharge chamber, flows through the oil separating means arranged in the discharge chamber at a position near the opening of the discharge passage, and then delivered to the outside of the compressor through the discharge passage. While the coolant gas flows through the oil separating means, oil mist contained in the coolant gas is separated from the coolant gas and is reserved in the oil chamber. Oil in the oil chamber returns to a low pressure part of the compressor, such as the suction chamber or a swash plate chamber, through the oil return passage, due to a pressure difference, and the oil is repeatedly used for lubrication.

According to the present invention, it is not necessary to increase the height of the entire compressor, since the oil separating means is arranged in the discharge chamber in the housing member and the oil chamber is arranged in the housing member.

The oil separating means preferably comprises a centrifugal type separating device, and in this case, a rotational flow is induced by the kinetic energy of the compressed coolant gas. Heavy oil mist is thus thrown outward by centrifugal force and is separated from the coolant gas. Also, the oil separating means preferably comprises a collision type separating device, and in this case, the coolant gas collides against the wall of the zigzag passage in the separating device and, as the heavy oil mist cannot change its course, it is separated from the coolant gas.

Preferably, the housing member has generally concentric outer and inner annular walls to form a central region in the inner annular wall and a peripheral region between the outer and inner annular walls, and a partition to divide the central region into first and second axially juxtaposed sub-regions one behind the other with the first sub-region located adjacent to the valve plate, the suction chamber being formed in the first sub-region, the oil chamber being formed in the second sub-region, the discharge chamber being formed in the peripheral region, the oil return passage being a small hole arranged in the partition to connect the oil chamber to the suction chamber.

Preferably, the housing member has generally concentric outer and inner annular walls to form a central region in the inner annular wall and a peripheral region between the outer and inner annular walls, a first partition to divide the central region into first and second axially juxtaposed sub-regions one behind the other with the first sub-region located adjacent to the valve plate, and a second partition to divide the peripheral region into third and fourth sub-regions with the third sub-region located at an upper position, the discharge chamber being formed in the first and third sub-regions which are in communication with each other, the oil chamber being formed in the second sub-region, the suction chamber being formed in the fourth sub-region, the discharge passage having an opening to the third sub-region, the oil separating means being arranged in the third sub-region and the oil return passage being a small hole arranged in the inner annular wall to connect the oil chamber to the suction chamber.

BRIEF DESCRIPTION OF THE DRAWINGS

The present invention will become more apparent from the following description of the preferred embodiments, with reference to the accompanying drawings in which.

DESCRIPTION OF THE PREFERRED EMBODIMENTS

Figure 1:
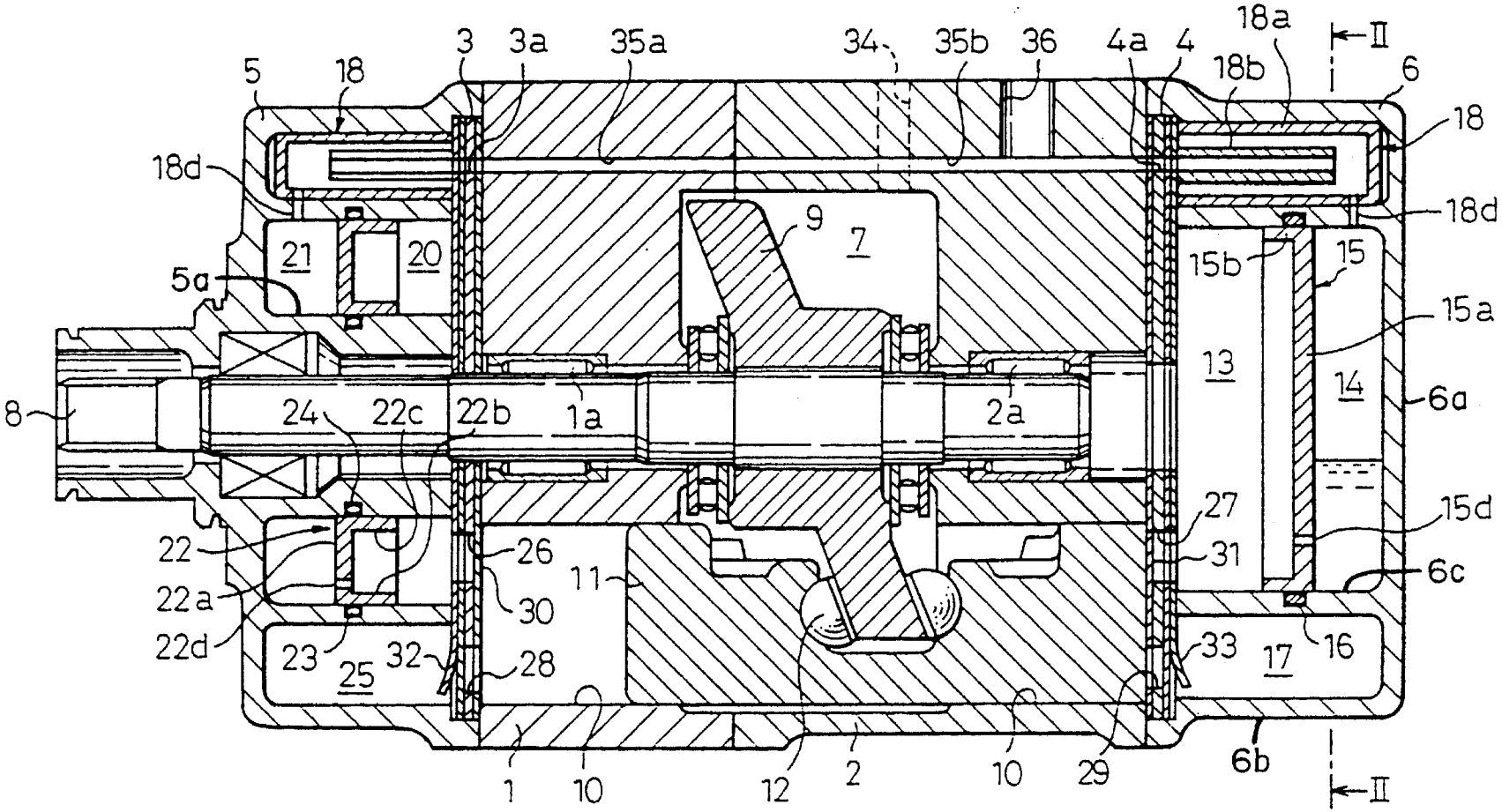
FIG. 1 is a cross-sectional view of a compressor according to the first embodiment of the present invention.
Figure 2:
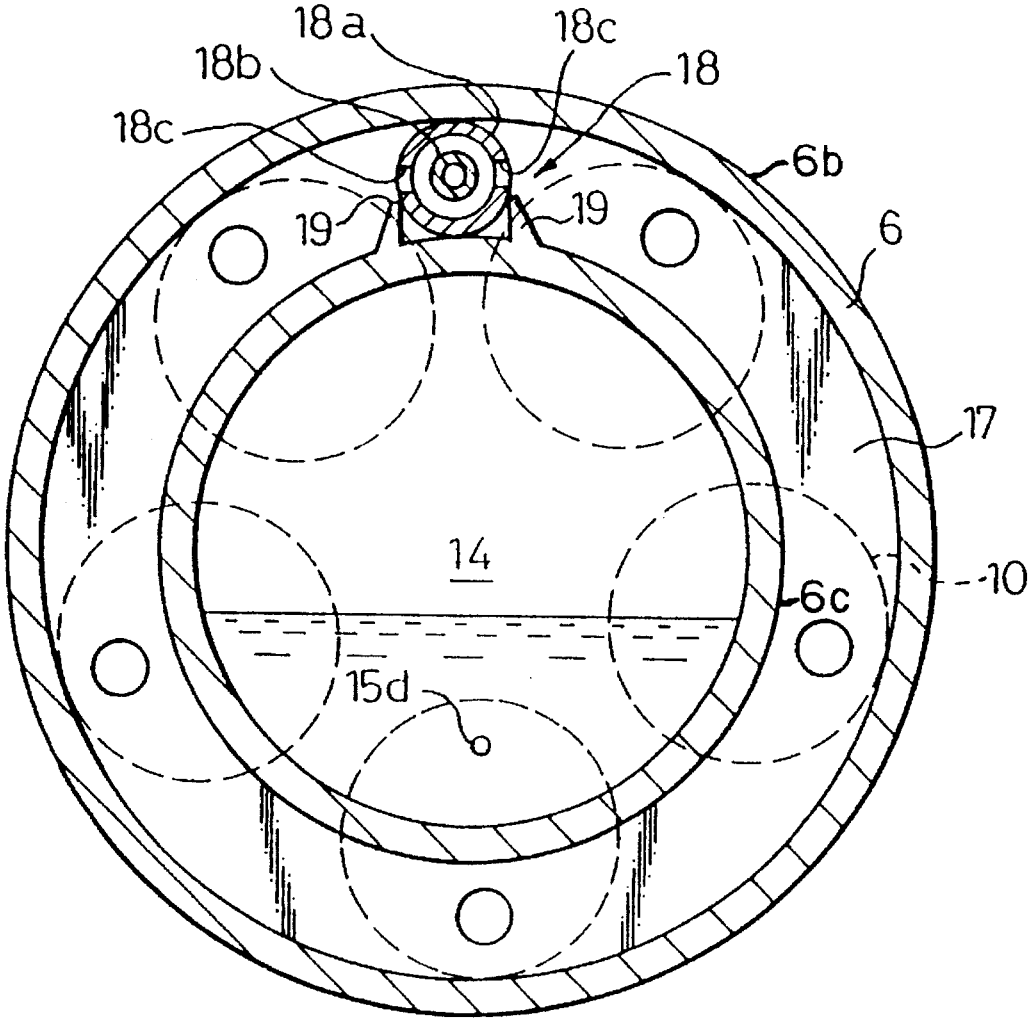
FIG. 2 is a cross-sectional view of the compressor of FIG. 1, taken along the line II—II in FIG. 1.

In FIGS. 1 and 2, the compressor according to the first embodiment of the present invention is a double-headed, five cylinder, swash plate type compressor. The compressor includes a cylinder block consisting of front and rear cylinder block members 1 and 2, front and rear valve plates 3 and 4 attached to the ends of the cylinder block 1 and 2, and front and rear housing members 5 and 6 attached to the cylinder block 1 and 2 via the valve plates 3 and 4, respectively. These members are fastened together by bolts (not shown). The cylinder block 1 and 2 has a swash plate chamber 7 formed therein at the juncture of two members, and a swash plate 9 is arranged in the swash plate chamber 7 and fixed to a drive shaft 8 which rotatably extends through the central holes 1*a* and 1*b* of the cylinder blocks 1 and 2. Five (or five pairs of) cylinder bores 10 are arranged in the cylinder block 1 and 2 parallel to, and equiangularly spaced around, the drive shaft 8, and double headed pistons 11 are inserted in the cylinder bores 10 to form compression chambers on either side of the pistons 11, each piston 11 being connected to the swash plate 9 by semi-spherical shoes 12.

The rear housing member 6 comprises a top wall 6*a* and generally concentric outer and inner annular walls 6*b* and 6*c* to form a central region in the inner annular wall 6*c* and a peripheral region between the outer and inner annular walls 6*b* and 6*c*. A partition 15 is arranged in the central region parallel to the valve plate 4 and the top wall 6*a* to further divide the central region into first and second axially juxtaposed sub-regions one behind the other. A suction chamber 13 is formed in the first sub-region located adjacent to the valve plate 4 and an oil chamber 14 is formed in the second sub-region located adjacent to the top wall 6*a*. The partition 15 includes a disk-like wall portion 15*a* and an outer peripheral wall portion 15*b* axially extending from the periphery of the disk-like wall portion 15*a*. A small oil return hole 15*d* having the diameter of approximately 0.1 to 0.2 millimeters is formed in the disk-like wall portion 15*a* at a lower position thereof to connect the oil chamber 14 to the suction chamber 13. An O-ring 16 is arranged on the outer periphery of the outer peripheral wall portion 15*b* of the partition 15 to prevent any leakage of fluid between the oil chamber 14 and the suction chamber 13.

An annular discharge chamber 17 is formed in the peripheral region of the rear housing member 6, the discharge chamber 17 having an axial length corresponding to the sum of the axial lengths of the oil chamber 14 and the suction chamber 13. A centrifugal oil separating device 18 is arranged in the discharge chamber 17 at an upper position thereof. The oil separating device 18 comprises an outer tube 18*a* having a closed rear end, an open front end, a length substantially identical to the axial dimension of the discharge chamber 17, and a diameter substantially identical to a radial dimension of the discharge chamber 17 between the outer and inner annular walls 6*b* and 6*c*. The oil separating device 18 also comprises an inner tube 18*b* concentrically arranged in the outer tube 18*a* and having opposite open ends and a length substantially identical to two-thirds of the length of the outer tube 18*a*. The outer tube 18*a* is fixedly held between a pair of projections 19 extending integrally with and axially from the inner annular wall 6*c*, and the inner tube 18*b* is fixed at its front end to the valve plate 4 by adhesion, as shown in FIG. 2. In addition, the outer tube 18*a* has a pair of opposite openings 18*c* extending along the length of the outer tube 18*a* to open to the discharge chamber 17. A through hole 18*d* is arranged in the outer tube 18*a* and the inner annular wall 6*c* at a position near the rear end of the bottom of the outer tube 18*a*.

On the front side, the front housing member 5 comprises a top wall and outer and inner annular walls, similar to those of the rear side, to form a central region and a peripheral region. The front housing member 5 also includes a central boss 5*a*. An annular partition 22 is arranged in the central region to divide the central region into first and second axially juxtaposed sub-regions one behind the other. An annular suction chamber 20 is formed in the first sub-region located adjacent to the valve plate 3 and an annular oil chamber 21 is formed in the second sub-region. The partition 22 has a ring-like wall portion 22*a* and an outer peripheral wall portion 22*b* axially extending from the periphery of the ring-like wall portion 22*a*. A small oil return hole 22*d* having a diameter of approximately 0.1 to 0.2 millimeters is formed in the ring-like wall portion 22*a* at a lower position thereof to connect the oil chamber 21 to the suction chamber 20. O-rings 23 and 24 are arranged on the outer and inner peripheries of the outer peripheral wall portion 22*b* of the partition 22 to prevent any leakage of fluid between the oil chamber 21 and the suction chamber 20.

An annular discharge chamber 25 is formed in the peripheral region of the front housing member 5, the discharge chamber 25 having the axial length corresponding to the sum of the axial lengths of the oil chamber 21 and the suction chamber 20. A centrifugal oil separating device 18 is arranged in the discharge chamber 25 at an upper position thereof. This centrifugal oil separating device 18 is similar to that in the rear discharge chamber 17, and a further explanation thereof is omitted. Also, a through hole 18*d* is arranged for connecting the interior of the outer tube 18*a* to the oil chamber 21 at a position near the rear end of the bottom of the outer tube 18*a*.

The front and rear valve plates 3 and 4 have suction ports 26 and 27 for introducing a low pressure coolant gas from the suction chambers 20 and 13 into the cylinder bores 10, and discharge ports 28 and 29 for discharging a high pressure coolant gas from the cylinder bores 10 into the discharge chambers 25 and 17, respectively. In addition, the front and rear valve plates 3 and 4 have suction valves 30 and 31 on the side of the pistons 11 and discharge valves 32 and 33 on the side of the housing members 5 and 6, respectively.

The rear cylinder block member 2 has at the upper part thereof a gas inlet 34 leading to the swash plate chamber 7. Suction passages (not shown) are formed in the portions of the cylinder block 1 and 2 between two adjacent cylinder bores 10 to connect the swash plate chamber 7 to the suction chambers 20 and 13, so that the coolant gas is introduced from the gas inlet 34 through the swash plate chamber 7 to the suction chambers 20 and 13. In addition, discharge passages 35*a* and 35*b* are formed in line in the portion of the cylinder block 1 and 2 between two adjacent cylinder bores 10 to interconnect the front and rear discharge chambers 25 and 17 to each other. The rear cylinder block member 2 has at the upper part thereof a gas outlet 36 leading to the discharge passages 35*a* and 35*b*. The discharge passage 35*a* and 35*b* are in communication with the interior of the inner tubes 18*b* of the oil separating devices 18 in the discharge chambers 21 and 17, via openings 3*a* and 4*a* of the front and rear valve plates 3 and 4.

In the operation of the compressor, when the swash plate 9 with the drive shaft 8 is rotated, the pistons 11 are moved reciprocatingly and the coolant gas is sucked, compressed, and discharged.

The coolant gas compressed and discharged into the discharge chambers 25 and 17 flows into the outer tubes 18*a* of the oil separating devices 18 arranged in the discharge chambers 25 and 17 at the upper parts thereof via the openings 18*c*. The coolant gas flows rotationally along the cylindrical space between the outer tubes 18*a* and the inner tubes 18, then into the inner tubes 18 from the open ends thereof, and further through openings 3*a* or 4*a* of the valve plates 3 and 4, the discharge passages 35*a* and 35*b*, and the gas outlets 36 to the outside of the compressor. When the coolant gas passes through the oil separating devices 18, the liquid oil or heavy oil mist contained in the coolant gas is splashed outwardly by a centrifugal force whereby it is separated from the coolant gas and falls along the inner surface of the outer tube 18*a* and into the oil chambers 21 and 14 via the through holes 22*d* and 18*d*. The oil is thus reserved in the oil chambers 21 and 14 and gradually returns to the suction chambers 20 and 13 through the oil return passages 22*d* and 15*d*, under a pressure difference, and is repeatedly used for lubrication.

In this way, since the oil separating devices 18 are arranged in the discharge chambers 25 and 17 in the housing members 5 and 6 and the oil chambers 21 and 14 are arranged in the housing members 5 and 6, it is not necessary to increase the height of the entire compressor and it is possible to avoid such a design of the compressor that the compressor must have an enlarged size due to the provision of the oil separating device incorporated in the compressor. In addition, it is possible to advantageously and simply arrange the oil chambers 21 and 14 by the partitions 22 and 15 so that the suction chambers 20 and 13 and the oil chambers 21 and 14 are axially juxtaposed one behind the other.

Figure 3:
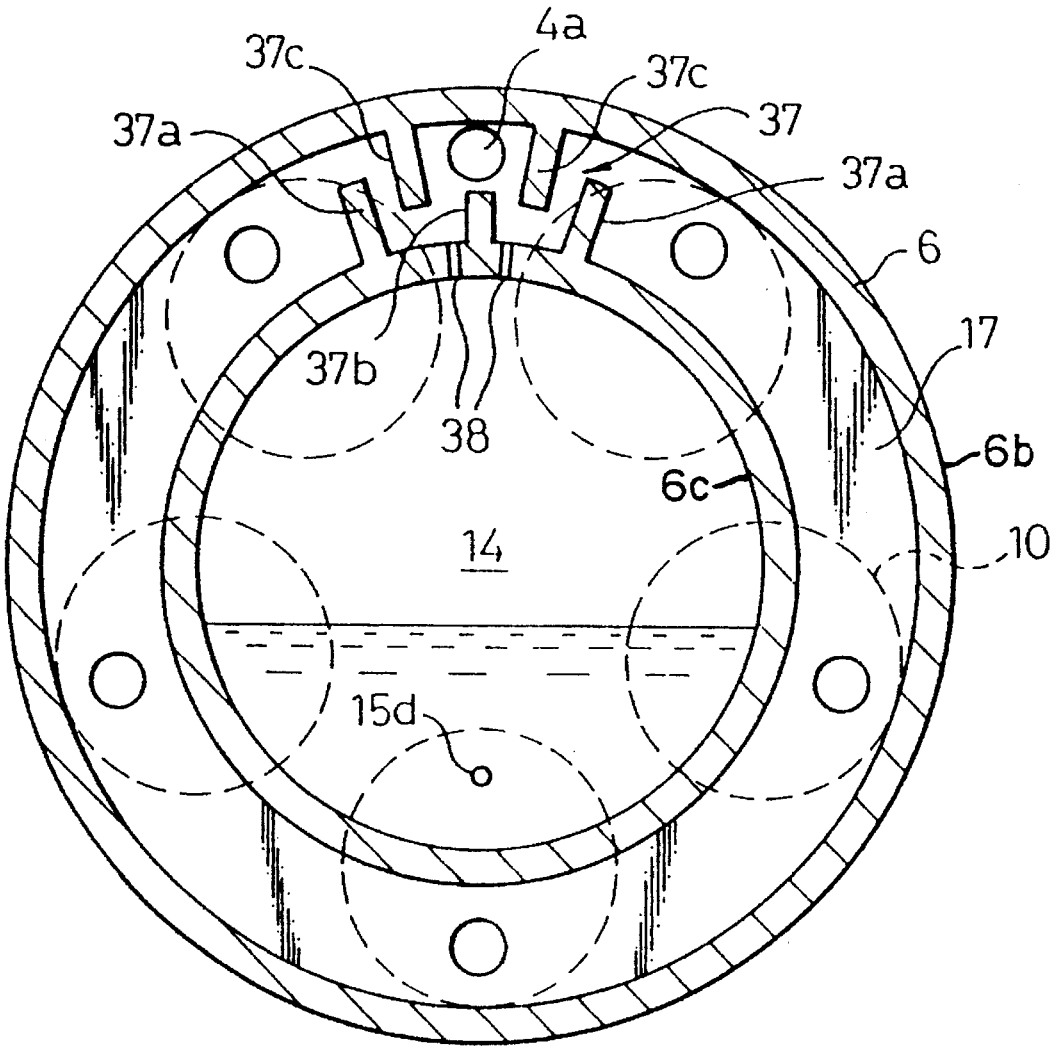
FIG. 3 is a cross-sectional view of a compressor according to the second embodiment of the present invention.

FIG. 3 shows the second embodiment of the present invention. The compressor of this embodiment is generally similar to the compressor of the previous embodiment, except that the centrifugal oil separating devices 18 are substituted by collision type oil separating devices 37. The oil separating devices 37 on the front and rear sides are identical to each other, and the oil separating device 37 on the rear side is described with reference to FIG. 3.

The collision type oil separating device 37 is arranged in the peripheral region of the discharge chamber 17 between outer and inner annular walls 6*b* and 6*c* thereof at the upper part thereof, and includes a pair of circumferentially outer walls 37*a* extending integrally with and radially outwardly from the inner annular wall 6*c* with a height corresponding to two-third of the radial dimension of the discharge chamber 17, a center wall 37*b* extending integrally with and radially outwardly from the inner annular wall 6*c* between the outer walls 37*a* with a height corresponding to one-third of the radial dimension of the discharge chamber 17, and a pair of intermediate walls 37*c* extending integrally with and radially inwardly from the outer annular wall 6*b* between the center wall 37*b* and the respective outer walls 37*a* with a height corresponding to two-thirds of the radial dimension of the discharge chamber 17. The walls 37*a*, 37*b* and 37*c* axially extend approximately along the length of the discharge chamber 17. The opening 4*a* leading to the discharge passage 35*b* opens at a position between the intermediate walls 37*c*, and a pair of holes 38 are arranged in the inner annular wall 6*c* on either side of the center wall 37*b* to interconnect the discharge chamber 17 with the oil chamber 14.

In the operation of the compressor of this embodiment, the coolant gas compressed and discharged into the discharge chambers 25 and 17 flows through the oil separating devices 37 arranged in the discharge chambers 25 and 17 at the upper parts thereof, openings 3*a* and 4*a* of the valve plates 3 and 4, the discharge passages 35*a* and 35*b*, and the gas outlets 36 to the outside of the compressor. While the coolant gas passes through the oil separating devices 37, the compressed coolant gas sequentially collides against the outer walls 37*a*, the intermediate walls 37*c*, and the center wall 37*b*, so that the liquid oil or heavy oil mist contained in the coolant gas is separated from the coolant gas. The separated oil falls in the spaces between the center wall 37*b* and the respective outer walls 37*a* and then into the oil chambers 21 and 14 via the holes 38. The oil is thus collected and reserved in the oil chambers 21 and 14. The oil in the oil chambers 21 and 14 returns to the suction chambers 20 and 13 through the oil return passages 22*d* and 15*d*, and is used for lubrication. Therefore, the operation and effect of the second embodiment are similar to those of the first embodiment.

Figure 4:
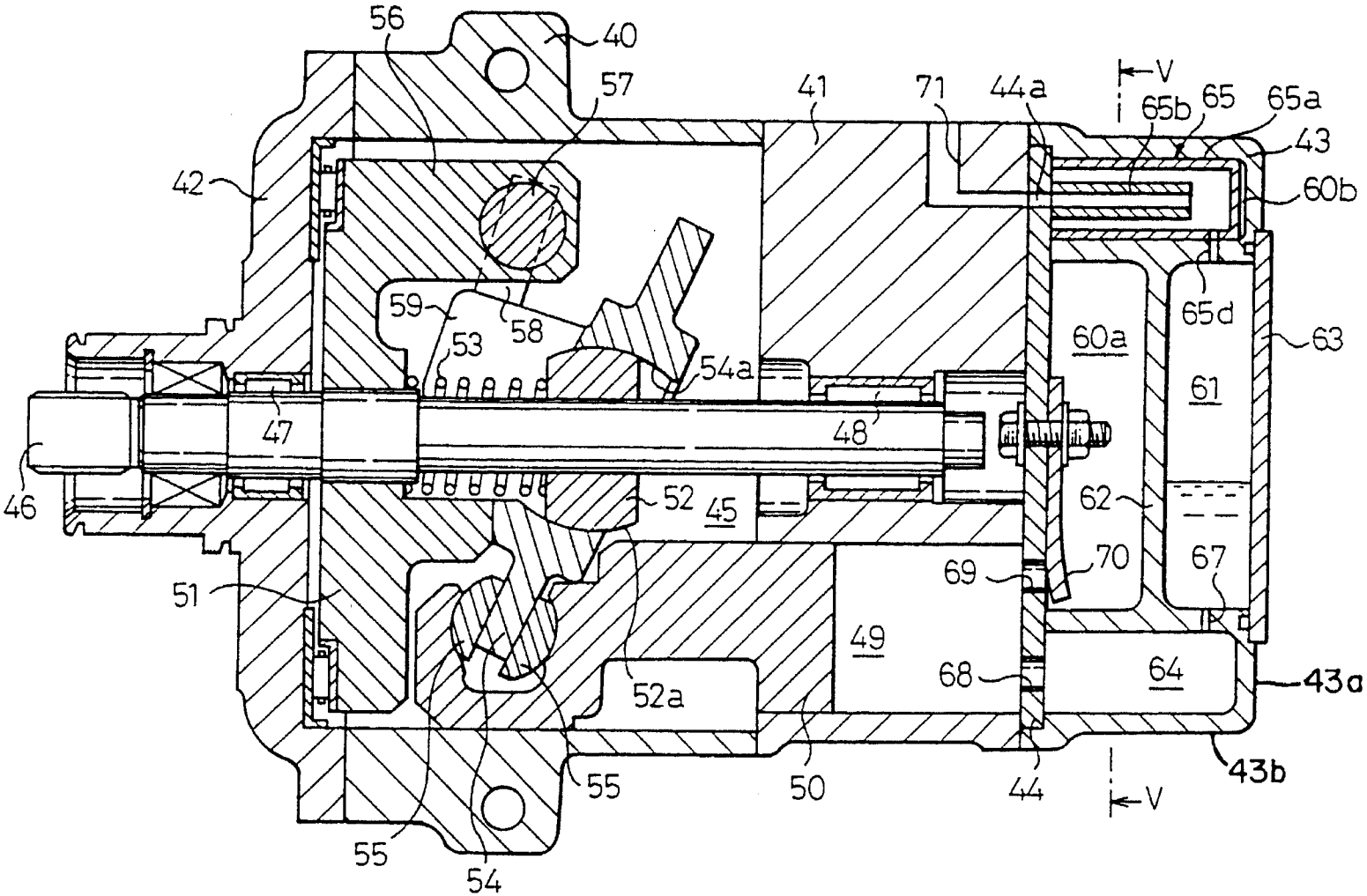
FIG. 4 is a cross-sectional view of a compressor according to the third embodiment of the present invention.
Figure 5:
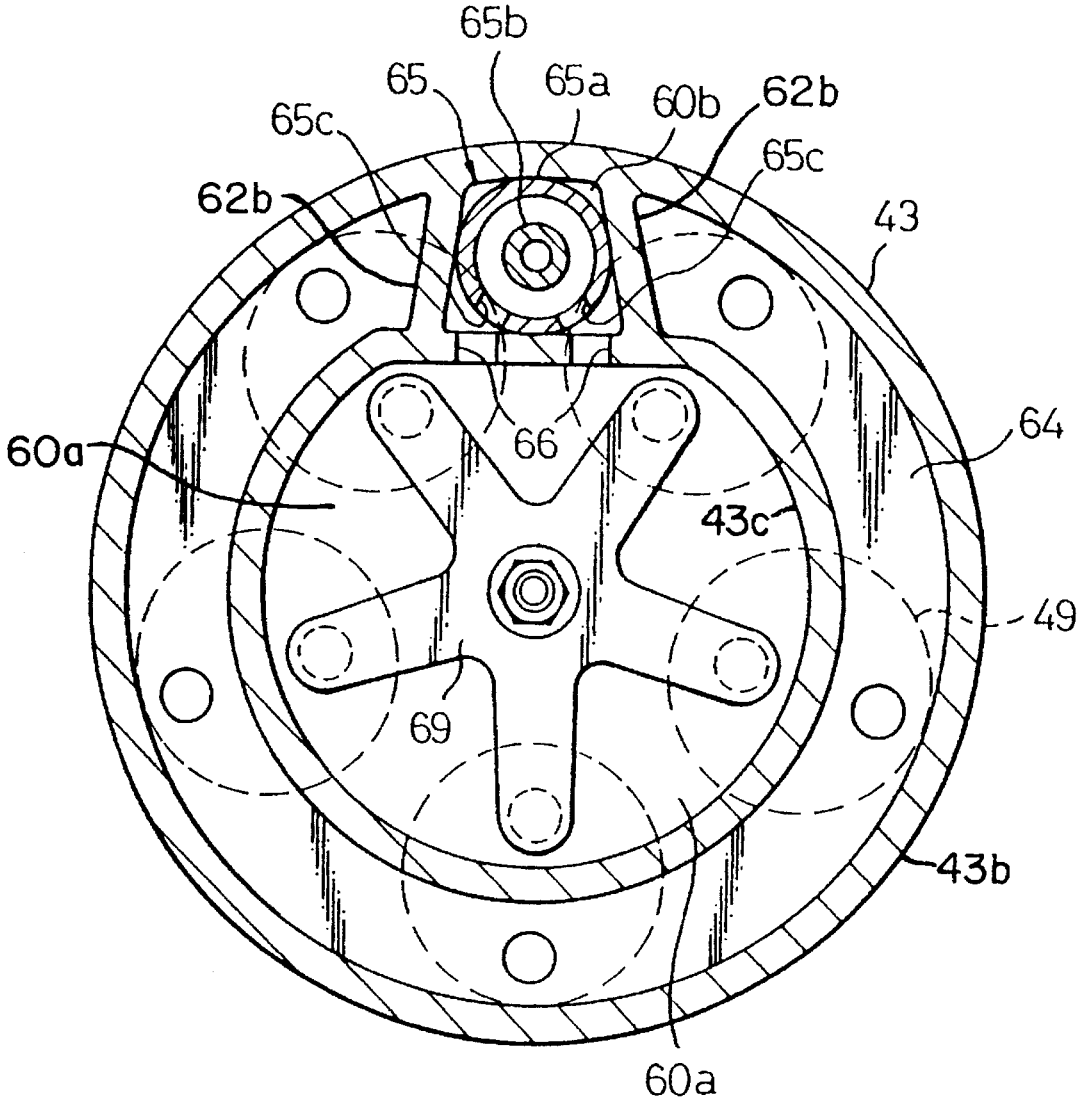
FIG. 5 is a cross-sectional view of the compressor of FIG. 4, taken along the line V—V in FIG. 4.

FIGS. 4 and 5 show a one sided swash-plate type compressor according to the third embodiment of the present invention, in which a suction chamber 64 and a discharge chamber 60*a* are arranged on the rear side only. The compressor includes a cylinder block consisting of front and rear cylinder block members 40 and 41, a front housing member 42 attached to the front end of the cylinder block 40 and 41, a rear valve plate 44 attached to the rear end of the cylinder block 40 and 41, and a rear housing member 43 attached to rear end of the cylinder block 40 and 41 via the valve plate 44. The cylinder block 40 and 41 and the front housing member 42 have a crank chamber 45 formed therein, and a drive shaft 46 operatively connected to an engine (not shown) which extends through the crank chamber 45 and is rotatably supported by bearings 47 and 48. The rear cylinder block member 41 has cylinder bores 49 arranged therein parallel to and equiangularly around the drive shaft 46, and pistons 50 are inserted in the cylinder bores 49.

In the crank chamber 45, the drive shaft 46 has a rotor 51 fixed thereto for rotation therewith and a bush 52 slidably fitted thereonto, the bush 52 having a spherical bearing surface 52*a*. A coil spring 53 is arranged between the rotor 51 and the bush 52 to bias the bush 52 toward the rear side. A swash plate 54 is tiltably coupled onto the bush 52, the swash plate 54 having a spherical inner surface 54*a* fitted onto the spherical bearing surface 52*a*. The swash plate 54 has a lower abutment portion facing the rotor 51, the lower abutment portion being in abutment against the rotor 51 when the swash plate 54 is brought into the position of FIG. 4 and the coil spring 53 is in its most compressed position, to restrict the upper limit of the tilting angle of the swash plate 54. The peripheral disk-liked portion of the swash plate 54 is connected to the pistons 50 by semi-spherical shoes 55.

The rotor 51 has an arm 56 extending rearwardly from the periphery of the rotor 51 at a position corresponding to the top dead center position of the swash plate 54, for constituting a hinge mechanism by which the swash plate 54 is tiltably moved. A support pin 57 is rotatably arranged at the end of the arm 56 and extends perpendicular to the axis of the drive shaft 46. The support pin 57 has cavities at its ends projecting on either side of the arm 56, and guide pins 58 slidably inserted in the cavities. The other ends of the guide pins 58 are fixed to an integral connecting portion 59 of the swash plate 54 extending toward the front side of the swash plate 54.

The rear housing member 43 comprises a top wall 43*a* and generally concentric outer and inner annular walls 43*b* and 43*c* to form central and peripheral regions. The inner annular wall 43*c* includes a flat top portion at the upper position thereof, as shown in FIG. 5. A first partition 62 is arranged in the central region to divide the central region into first and second axially juxtaposed sub-regions one behind the other. A main discharge chamber 60*a* is formed in the first sub-region located adjacent to the valve plate 44 and an oil chamber 61 is formed in the second sub-region located adjacent to the top wall 43*a*. In this embodiment, a cover 63 is fixed to the central region of the top wall 43*a*.

The peripheral region is further divided into third and fourth sub-regions by a further partition 62*b* comprising a pair of substantially vertically extending walls between the outer and inner annular walls 43*b* and 43*c* above the flat portion of the inner annular wall 43*c*, as shown in FIG. 5. A sub-discharge chamber 60*b* having the axial length corresponding to the sum of the axial lengths of the main discharge chamber 60*a* and the oil chamber 61 is formed in the third sub-region located above the flat top portion of the inner annular wall 43*c*. The main discharge chamber 60*a* and the sub-discharge chamber 60*b* are in communication with each other through holes 66. A suction chamber 64 having a C-shaped cross-section is formed in the fourth sub-region, i.e., in the remainding space in the peripheral region.

A centrifugal oil separating device 65 is arranged in the sub-discharge chamber 60*b*. The oil separating device 65 comprises an outer tube 65*a* and an inner tube 65*b* concentrically arranged in the outer tube 65*a* having opposite open ends and a length substantially identical to two thirds of the length of the outer tube 65*a*. The oil separating device 65 is generally similar to that in the first embodiment, except that the outer tube 65*a* has a pair of openings 65*c* arranged at lower positions. A through hole 65*d* is arranged in the outer tube 65*a* and the inner annular wall 43*c* at a position near the rear end of the bottom of the outer tube 65*a* to connect the sub-discharge chamber 60*b* to the oil chamber 61. A small oil return hole 67 having the diameter of approximately 0.1 to 0.2 millimeters is formed in the inner annular wall 43*c* at a lower position thereof to connect the oil chamber 61 to the suction chamber 64.

The valve plate 44 has suction ports 68 for introducing a low pressure coolant gas from the suction chamber 64 into the cylinder bores 49, and discharge ports 69 for discharging a high pressure coolant gas from the cylinder bores 49 into the main discharge chamber 60*a*. In addition, the valve plate 44 has suction valves (not shown) on the side of the rear cylinder block member 41 and discharge valves 70 on the side of the housing member 43. In addition, the valve plate 44 has an opening 44*a* at a position corresponding to the position of the oil separating device 65, the opening 44*a* leading to a discharge passage 71 of the rear cylinder block member 41. A coolant gas is introduced from the outside into the suction chamber 64 via an inlet (not shown) arranged in the periphery of the rear housing member 43. In addition, a control valve (not shown) is arranged in the rear housing member 43 for controlling the pressure in the crank chamber 45 by which the tilting angle of the swash plate 54 can be controlled. The detailed description regarding the control of the tilting angle of the swash plate 54 is omitted here.

In the operation of the compressor, when the swash plate 54 with the drive shaft 46 is rotated, the pistons 50 are moved reciprocatingly in the respective cylinder bores 49, and the coolant gas is sucked, compressed, and then discharged.

The coolant gas compressed and discharged into the main discharge chamber 60*a* and then into the sub-discharge chamber 60*b* via the holes 66, and flows into the outer tubes 65*a* of the oil separating devices 65 in the sub-discharge chamber 65*b* at the upper part thereof via the openings 65*c*. The coolant gas flows rotationally along the cylindrical space between the outer and inner tubes 65*a* and 65*b*, then into the inner tubes 65*b* from the open ends thereof, and further through openings 44*a* of the valve plate 44, the discharge passage 71 to the outside of the compressor. While the coolant gas passes through the oil separating device 65, the liquid oil or heavy oil mist contained in the coolant gas is splashed outwardly by a centrifugal force whereby it is separated from the coolant gas and falls along the inner surface of the outer tube 65*a* into the oil chamber 61 via the hole 65*d*. The oil is thus reserved in the oil chamber 61 and returns to the suction chamber 64 through the oil return passage 67, under a pressure difference, and used for lubrication.

In this way, since the oil separating device 65 is arranged in the discharge chamber 60*b* in the housing member 43 and the oil chamber 61 is arranged in the housing member 43, there is no need to increase the height of the entire compressor and it is possible to keep the compressor the same size even though the oil separating device is incorporated in the compressor.

It will be noted that the first and second embodiments are described with reference to an example regarding a double headed swash type compressor having a suction chamber in the central region of a housing member and a discharge chamber in the peripheral region, but it is possible to apply the present invention to a double headed swash type compressor having a discharge chamber in the central region of a housing member and a suction chamber in the peripheral region.

The third embodiment is described with reference to an example regarding a one sided swash type compressor having a discharge chamber in the central region of a housing member and a suction chamber in the peripheral region, but it is possible to apply the present invention to a one sided swash type compressor having a suction chamber in the central region of a housing member and a discharge chamber in the peripheral region. In addition, it is, of course, possible to use a collision type oil separating device in the third embodiment in place of the centrifugal type oil separating device.

As explained above, according to the present invention, the oil separating device is arranged in the discharge chamber in the housing member and the oil chamber is arranged in the housing member, so there is no need for increasing the height of the entire compressor and it is possible to keep the compressor the same size even though the oil separating device is incorporated in the compressor. In addition, it is possible to advantageously and simply arrange the oil chamber 21 or 14 using the partitions 22 and 15 which divide the central regions of the housing members 5 and 6 into axially juxtaposed the suction chambers 20 and 13 and the oil chambers 21 and 14 one behind the other.

We claim:

1. A reciprocating compressor comprising:

a cylinder block having bores;

pistons arranged in the bores and reciprocatingly moved by moving means;

a valve plate arranged at one end of the cylinder block;

a housing member having a discharge chamber formed therein arranged adjacent to the valve plate on a side away from the cylinder block;

a discharge passage having an opening to the discharge chamber for introducing a compressed coolant gas in the discharge chamber to the outside of the compressor;

a suction chamber;

oil separating means arranged in said discharge chamber at a position near said opening of the discharge passage whereby all the compressed coolant gas which passes out of the compressor passes through the oil separating means;

an oil chamber arranged in the housing member for reserving oil separated from the coolant gas by said oil separating means; and an oil return passage connecting the oil chamber to a low pressure part of the compressor.

2. A compressor according to claim 1, wherein said oil separating means comprising a centrifugal type separating device.

3. A compressor according to claim 1, wherein said oil separating means comprising a collision type separating device.

4. A compressor according to claim 1, wherein said oil separating means is arranged in said discharge chamber at an upper position and said oil chamber is arranged below the oil separating means.

5. A compressor according to claim 1, wherein said housing member has generally concentric outer and inner annular walls to form a central region in the inner annular wall and a peripheral region between the outer and inner annular walls, and a partition to divide said central region into first and second axially juxtaposed sub-regions one behind the other with the first sub-region located adjacent to the valve plate, the suction chamber being formed in the first sub-region, the oil chamber being formed in the second sub-region, the discharge chamber being formed in the peripheral region, said oil return passage being a small hole arranged in the partition to connecting the oil chamber to the suction chamber.

6. A compressor according to claim 1, wherein said housing member has generally concentric outer and inner annular walls to form a central region in the inner annular wall and a peripheral region between the outer and inner annular walls, a first partition to divide said central region into first and second axially juxtaposed sub-regions one behind the other with the first sub-region located adjacent to the valve plate, and a second partition to divide said peripheral region into third and fourth sub-regions with the third sub-region located at an upper position, the discharge chamber being formed in the first and third sub-regions which are in communication with each other, the oil chamber being formed in the second sub-region, the suction chamber being formed in the fourth sub-region, said discharge passage having an opening to the third sub-region, said oil separating means being arranged in the third sub-region, said oil return passage being a small hole arranged in the inner annular wall to connect the oil chamber to the suction chamber.

7. A compressor according to claim 1, wherein said housing member has generally concentric outer and inner annular walls to form a central region in the inner annular wall and a peripheral region between the outer and inner annular walls, and a first partition to divide said central region into first and second axially juxtaposed sub-regions one behind the other with the first sub-region located adjacent to the valve plate, the oil chamber being formed in the second sub-region remote from the valve plate, the discharge chamber being formed in one of the peripheral region and the first sub-region, the suction chamber being formed in the other of the peripheral region and the first sub-region.

8. A compressor according to claim 1, further comprising a second valve plate attached to the other end of the cylinder block, and a second housing member attached to the cylinder block via the second valve plate and having a second discharge chamber formed therein.

9. A compressor according to claim 8, further comprising second oil separating means arranged in said second discharge chamber, a second oil chamber arranged in the second housing member for reserving oil separated from the coolant gas by said second oil separating means, a second oil return passage connecting the second oil chamber to a low pressure part of the compressor, and a passage connecting the second discharge chamber to the first discharge chamber.

10. A compressor according to claim 1, wherein said moving means comprises a swash plate.

11. A compressor according to claim 9, further comprising means for adjusting the tilting angle of the swash plate to constitute a variable-capacity compressor.

12. A reciprocating compressor comprising:

a cylinder block having bores;

pistons arranged in the bores and reciprocatingly moved by moving means;

a valve plate arranged at one end of the cylinder block;

a housing member having a discharge chamber formed therein arranged adjacent to the valve plate on a side away from the cylinder block;

a discharge passage having an opening to the discharge chamber for introducing a compressed coolant gas in the discharge chamber to the outside of the compressor;

a suction chamber;

oil separating means arranged in said discharge chamber at a position near said opening of the discharge passage, said oil separating means being compartmentalized and formed within said discharge chamber near said opening of the discharge passage;

an oil chamber arranged in the housing member for reserving oil separated from the coolant gas by said oil separating means; and an oil return passage connecting the oil chamber to a low pressure part of the compressor.

13. A reciprocating compressor comprising:

a cylinder block having bores;

pistons arranged in the bores and reciprocatingly moved by moving means;

a valve plate arranged at one end of the cylinder block;

a housing member having a discharge chamber formed therein arranged adjacent to the valve plate on a side away from the cylinder block; the housing member having generally concentric outer and inner annular walls to form a central region within the inner annular wall and a peripheral region between the outer annular wall and the inner annular wall and a first partition to divide the central region into a first and a second juxtaposed sub-regions, one behind the other, with the first subregion located adjacent to the valve plate;

a discharge passage having an opening to the discharge chamber for introducing a compressed coolant gas in the discharge chamber to the outside of the compressor;

a suction chamber;

oil separating means arranged in said discharge chamber at a position near said opening of the discharge passage, said oil separating means being compartmentalized and formed within said discharge chamber near said opening of the discharge passage;

an oil chamber arranged in the housing member for reserving oil separated from the coolant gas by said oil separating means; and an oil return passage connecting the oil chamber to a low pressure part of the compressor.

* * * * *